US006506083B1

(12) United States Patent
Bickford et al.

(10) Patent No.: US 6,506,083 B1
(45) Date of Patent: Jan. 14, 2003

(54) METAL-SEALED, THERMOPLASTIC ELECTRICAL FEEDTHROUGH

(75) Inventors: Gary P. Bickford, Houston, TX (US); Pete Howard, Bellville, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/681,247

(22) Filed: Mar. 6, 2001

(51) Int. Cl.[7] ..... H01R 13/405
(52) U.S. Cl. ..... 439/736; 439/281; 439/606
(58) Field of Search ..... 439/736, 281, 439/606

(56) References Cited

U.S. PATENT DOCUMENTS 3,624,585 A * 11/1971 Kokalas ..... 439/195
3,747,048 A * 7/1973 Johnson et al. ..... 439/276
3,848,950 A * 11/1974 McCormick et al. ..... 439/311
3,897,131 A * 7/1975 Stauffer ..... 439/655
4,296,986 A * 10/1981 Herrmann, Jr. ..... 439/322
4,441,777 A * 4/1984 Harootion ..... 339/94 M
6,165,013 A * 12/2000 Broussard ..... 439/606

* cited by examiner

*Primary Examiner*—Gary Paumen
*Assistant Examiner*—Ann McCamey
(74) *Attorney, Agent, or Firm*—Wayne I. Kanak; Brigitte L. Jeffery; John J. Ryberg

(57) ABSTRACT

An electrical feedthrough includes a connector body made of a metallic material, at least one contact pin inserted through a cavity in the connector body, and an insulating body made of a thermoplastic material formed between the connector body and the contact pin so as to provide a hermetic seal between the connector body and the contact pin.

20 Claims, 6 Drawing Sheets

METAL-SEALED, THERMOPLASTIC ELECTRICAL FEEDTHROUGH

BACKGROUND OF INVENTION

The invention relates to electrical feedthroughs for making electrical connections, particularly in a high temperature and pressure environment.

In oil and gas operations, it is often necessary to make an electrical connection from the outside to the inside of a housing which is either sealed, pressurized, or filled with fluid. Such electrical connections are used to transmit power and data signals. In subsea and downhole environments, these electrical connections are subjected to extreme temperatures and pressures, which can run as high as 500° F. and 25,000 psi, respectively. For permanent installations in the subsea or downhole environment, it is important that these electrical connections are reliable. In particular, it is important that fluid is prevented from penetrating the electrical connections because the presence of fluid in the electrical connections can cause a short circuit in the system. It is also important that the electrical connections are able to insulate typical tool voltages after being sealed from conductive seawater and/or wellbore fluid.

In the oil and gas field, the term "electrical feedthrough" is used to refer to an electrical connector that operates with a certain pressure differential across it. In general, the electrical feedthrough includes one or more contact pins disposed within a connector body. The ends of the contact pins extend from the connector body for connection to circuit leads. The contact pins are sealed in an insulatirig body. The insulating body is typically made of glass or ceramic where moderate to high pressures and temperatures are concerned. Recently, the insulating body has also been made of a thermoplastic material such as polyetherketone ("PEEK"). The insulating body acts as a seal between the contact pins and the connector body. In downhole and subsea environments, the connector body is mounted in a seal bore in a pressure bulkhead. Typically, one or more elastomer seals are provided on the outer diameter of the connector body to form a seal between the connector body and the pressure bulkhead.

Under long-term exposure to high pressure and temperature and corrosive fluids, the elastomer seals will eventually fail, allowing fluid to enter the pressure bulkhead and reach the contact pins. If the invading fluid is conductive, which is usually the case in downhole and subsea environments, a short circuit may occur in the system, resulting in power and data loss. An alternative to using elastomer seals is to arrange the insulating body in a metal body that can be secured to the pressure bulkhead by a weld or metal-to-metal seal. This will prevent fluid from getting in between the pressure bulkhead and the metal body. This technique has been used in glass-sealed and ceramic-sealed electrical feedthroughs. However, the electrical connection may still be subject to failure. In the case of glass-sealed electrical feedthroughs, moisture can condense in the small glass interface between the contact pin and the metal body, leading to eventual short circuit in the system. In the case of ceramic-sealed feedthroughs, porosity of the ceramic material itself can lead to absorption of moisture and eventual short circuit.

SUMMARY OF INVENTION

In one aspect, the invention relates to an electrical feedthrough which comprises a connector body made of a metallic material, at least one contact pin inserted through a cavity in the connector body, and an insulating body made of a thermoplastic material formed between the connector body and the contact pin so as to provide a hermetic seal between the connector body and the contact pin.

Other aspects and advantages of the invention will be apparent from the following description and the appended claims.

DETAILED DESCRIPTION

Figure 1:
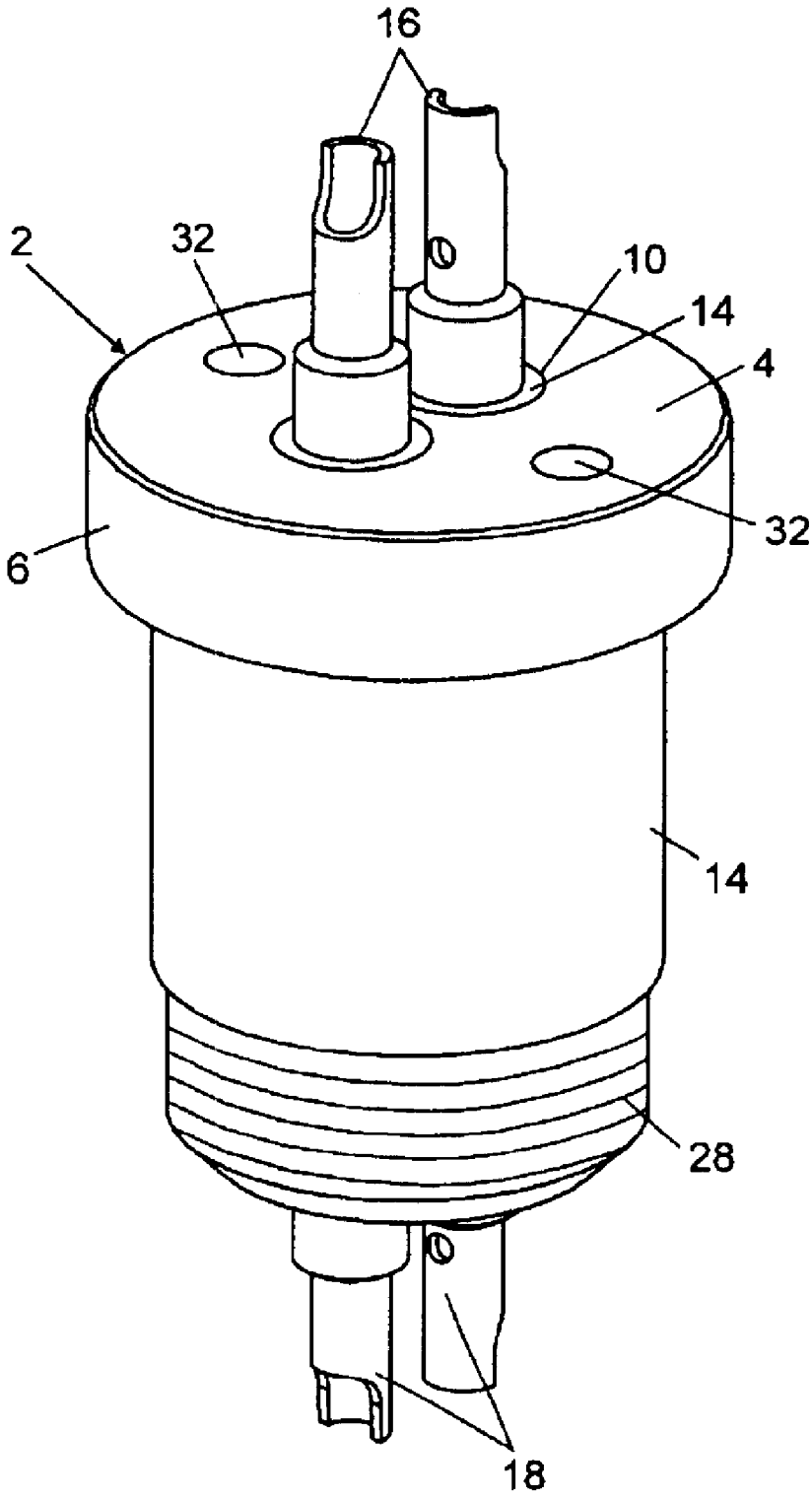
FIG. 1 is a three-dimensional view of an electrical feedthrough according to one embodiment of the invention.

Various embodiments of the invention will now be described with reference to the accompanying drawings. FIG. 1 shows a three-dimensional view of an electrical feedthrough 2 according to one embodiment of the invention. The electrical feedthrough 2 includes a connector body 4 having a flange 6 on one end. The connector body 4 is made of a metallic material. In one embodiment, the metallic material is a weldable material. For subsea or downhole applications, the metallic material is preferably corrosion-resistant. An example of a suitable metallic material for use in making the connector body 4 is nickel-chromium-iron alloy. However, other types of metallic materials may also be used. The connector body 4 has a cavity (8 in FIG. 2) which is connected to holes 10 in the flange 6. In the illustrated embodiment, two holes 10 are provided in the flange 6. In alternate embodiments, a single hole 10 or more than two holes 10 may be provided in the flange 6.

Figure 2:
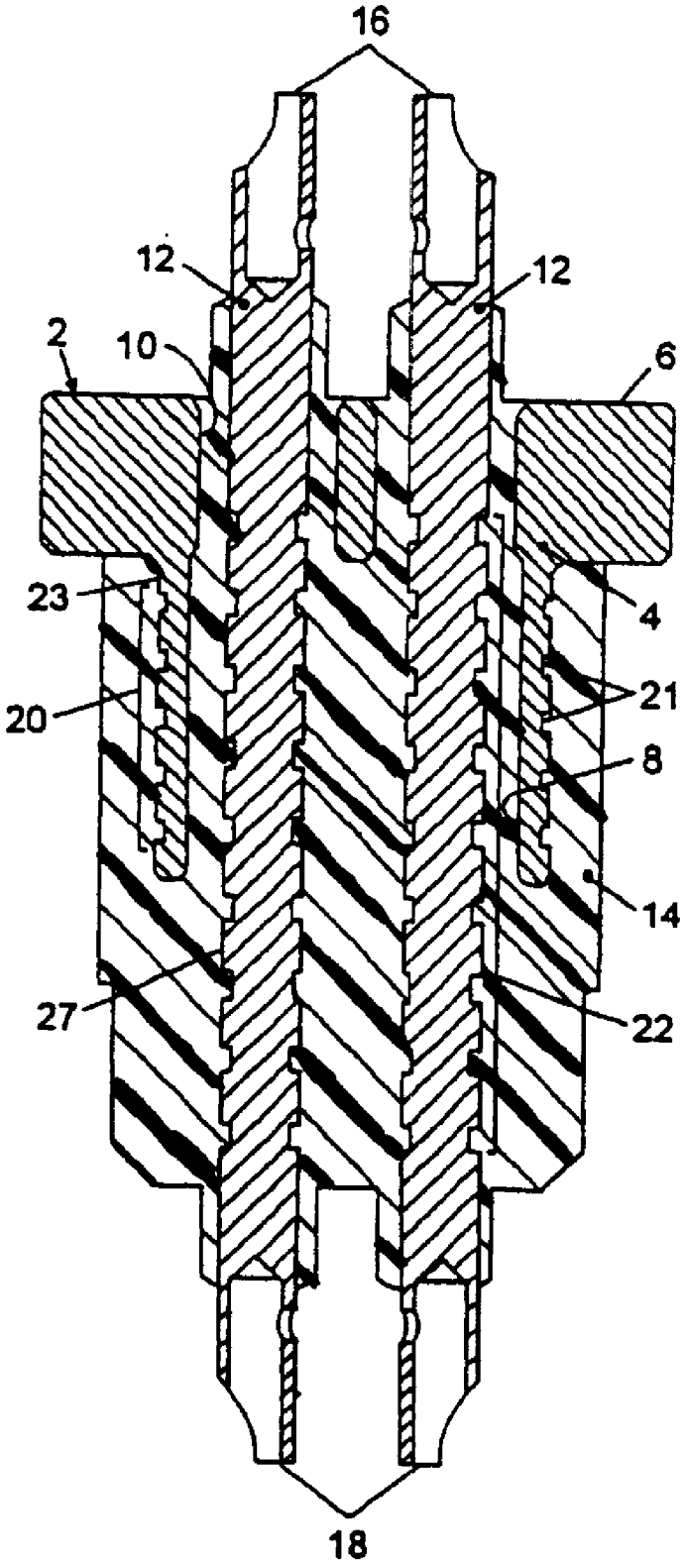
FIG. 2 is a vertical cross-section of the electrical feedthrough shown in FIG. 1.

Referring to FIG. 2, contact pins 12 extend through the holes 10 and cavity 8 in the connector body 4. The contact pins 12 are made of a conductive material, e.g., nickel-chromium-iron alloy. An insulating body 14 separates and forms a hermetic seal on the contact pins 12. In one embodiment, the insulating body 14 is made of a thermoplastic material. The term "thermoplastic," as used herein, is used to refer to plastic materials that can be melted and injected. A suitable thermoplastic material for use in the invention is PEEK. However, other types of thermoplastic materials can be used, depending on the pressure and temperature requirements of the completed electrical feedthrough 2. Solder cups 16, 18 are provided on the ends of the contact pins 12. The solder cups 16, 18 project from the flange 6and the insulating body 14, respectively, to facilitate connection to circuit leads.

In one embodiment, the insulating body 14 is molded over the connector body 4 and the contact pins 12 using, for example, injection molding. This involves making a mold (not shown) having a negative of the insulating body 14. The connector body 4 and contact pins 12 are arranged in the mold (not shown). A thermoplastic material is melted and injected into the mold. The thermoplastic material is then cooled, and the electrical feedthrough 2 is ejected from the mold. During cooling, the thermoplastic material shrinks. The shrinking assists in making a pressure seal between the insulating body 14 and the contact pins 12, but also tends to make the insulating body 14 shrink away from the cavity 8 of the connector body 4.

To assist in forming a tight pressure seal between the connector body 4 and the insulating body 14, the outer surface 23 of the connector body 4 includes an interlocking structure 20. In the illustrated embodiment, the interlocking structure 20 comprises grooves 21. However, the invention is not limited to this particular type of interlocking structure. Any form of texturing on the outer surface 23 may provide the desired interlocking structure. For example, the outer surface 23 could be sandblasted or roughened to provide the interlocking structure. As the thermoplastic material cools, the insulating body 14 will shrink and seal on the interlocking structure 20 and provide a tight pressure seal between the contact pins 12 and the connector body 4. A similar interlocking structure 22 is provided on the outer diameters 27 of the contact pins 12. Like the interlocking structure 20, the interlocking structure 22 provides a tight pressure seal between the contact pins 12 and the insulating body 14. In addition, the interlocking structures 20, 22 will assist in restricting creep of the thermoplastic material at high differential pressures and temperatures.

Figure 3:
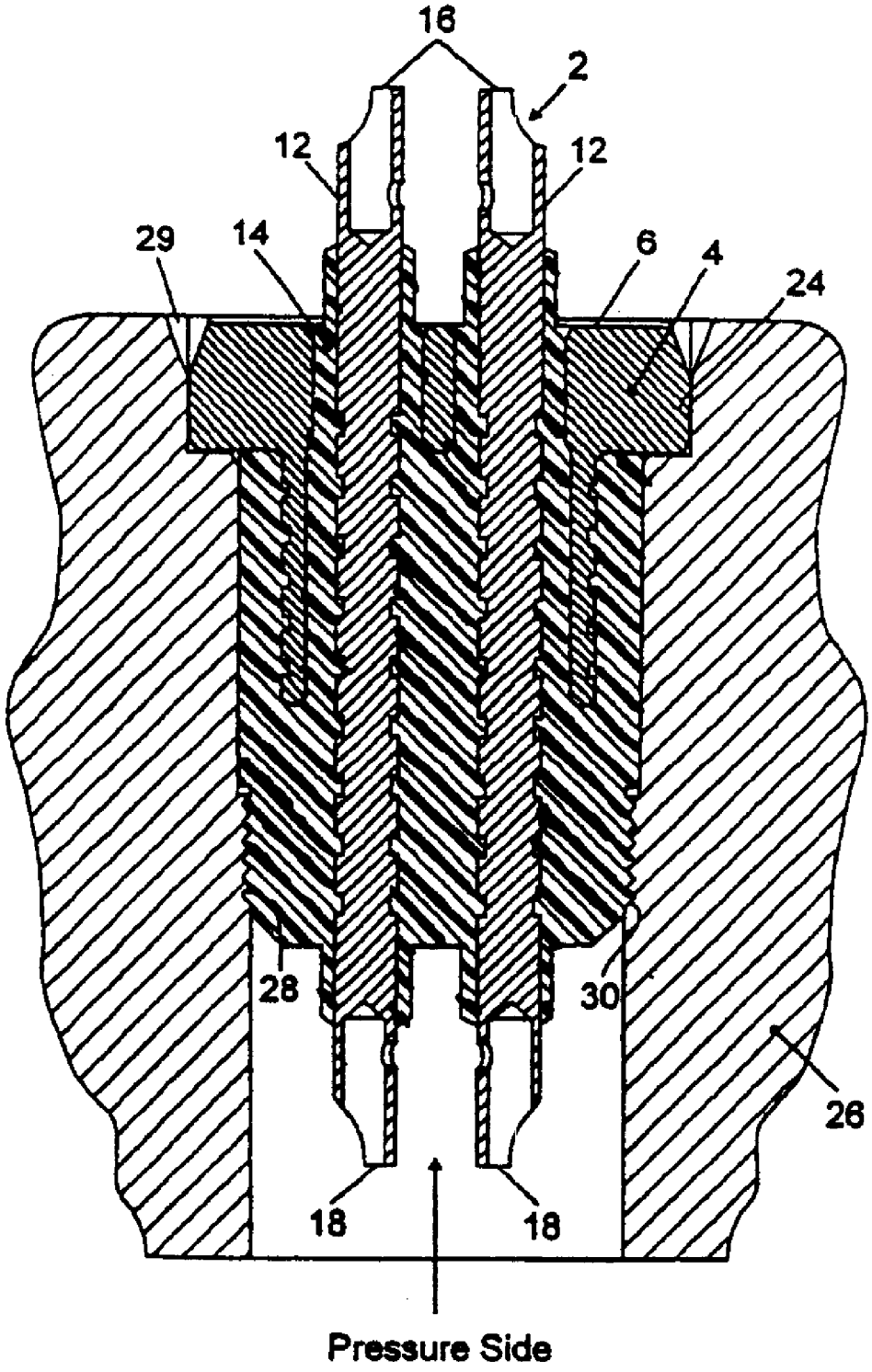
FIGS. 3 and 4 show different mounting arrangements of the electrical feedthrough in a pressure bulkhead.
Figure 4:
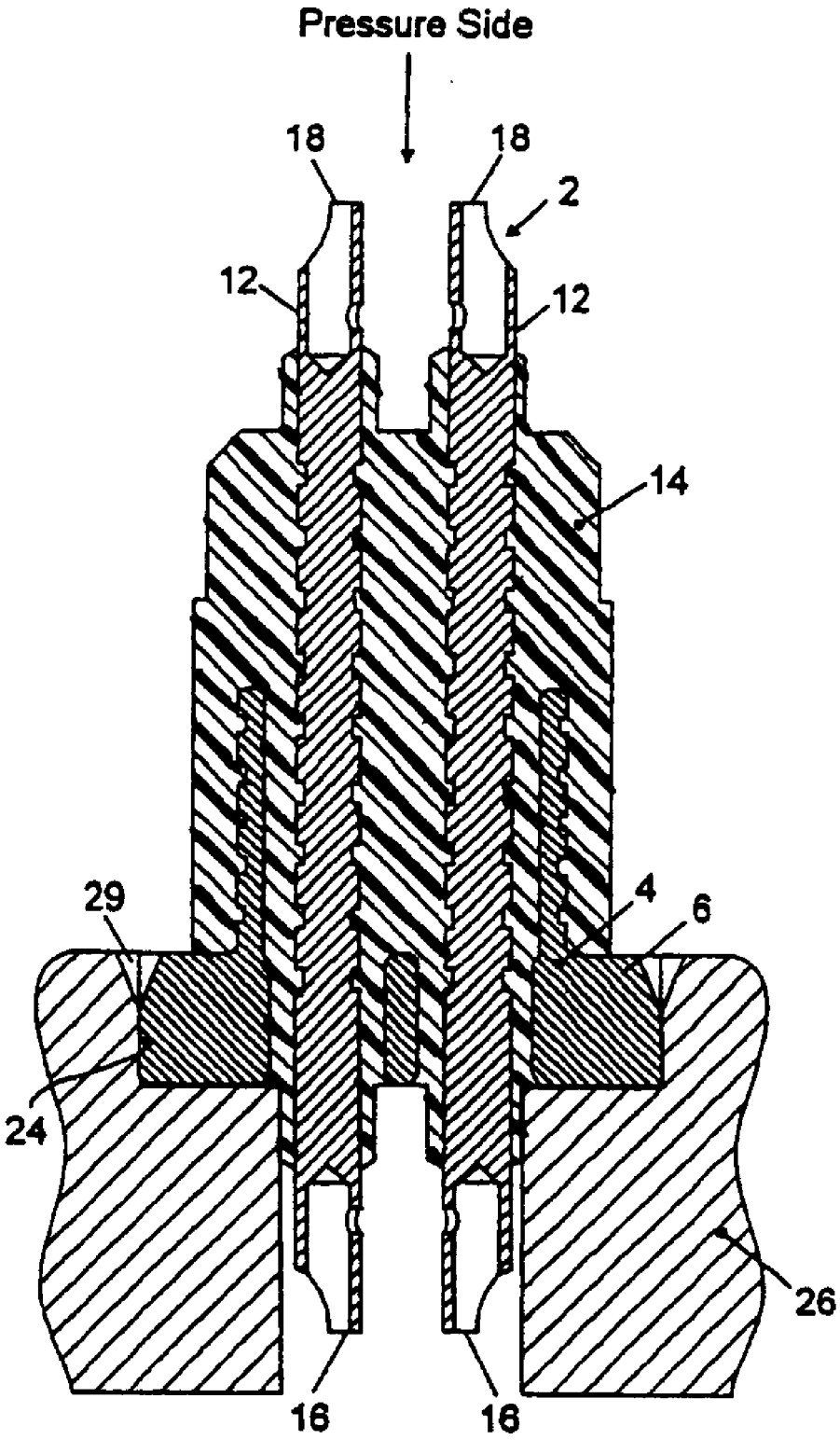

FIG. 3 shows the connector body 4 supported in a cavity 24 in a pressure bulkhead 26. The electrical feedthrough 2 extends into the pressure bulkhead 26 such that the solder cups 18 are exposed to air pressure or ambient pressure inside the pressure bulkhead 26 while the solder cups 16 are exposed to pressure outside the pressure bulkhead 26. FIG. 4 shows an alternative arrangement for the electrical feedthrough 2. In this figure, the solder cups 18 are exposed to pressure outside the pressure bulkhead 26 while the solder cups 16 are exposed to air pressure or ambient pressure inside the pressure bulkhead 26. In both FIGS. 3 and 4, the flange 6 of the connector body 4 is secured to the pressure bulkhead 26 by weld 29. To make the welded connection, the pressure bulkhead 26 should, preferably, be made of a weldable metallic material.

Referring back to FIG. 3, the insulating body 14 has a threaded surface 28 (also shown in FIG. 1) which engages with a similar threaded surface 30 in the pressure bulkhead 26. In one embodiment, tool holes (32 in FIG. 1) are provided on the flange 6 (also shown in FIG. 1) which can be engaged with a tool (not shown), e.g., a spanner. This allows the tool (not shown) to be used to turn the electrical feedthrough 2 relative to the pressure bulkhead 26 such that the threaded surface 28 (also shown in FIG. 1) on the insulating body 14 engages with the threaded surface 30 in the pressure bulkhead 26. In alternate embodiments, other means of securing the insulating body 14 to the pressure bulkhead 26 can be used. For example, a key and slot or other mutually cooperating structures can be used to secure the insulating body 14 to the pressure bulkhead 26. Securing the electrical feedthrough 2 to the pressure bulkhead 26 will provide stabilization for subsequent welding to the pressure bulkhead 26.

In both FIGS. 3 and 4, the weld 29 between the flange 6 of the connector body 4 and the pressure bulkhead 26 may be formed by electron-beam welding or other suitable welding technique. Electron-beam welding is a high purity process that allows welding of reactive materials that are very sensitive to contamination. For electron-beam welding, the weldable material used in the connector body 4 and the pressure bulkhead 26 should, preferably, be identical. Also, penetration depths of the electron beam should be set carefully to prevent heat damage to the thermoplastic material used in the insulating body 14 during welding. Preferably, the thermoplastic material used in the insulating body 14 is heat-resistant so as to be able to withstand welding.

Figure 5:
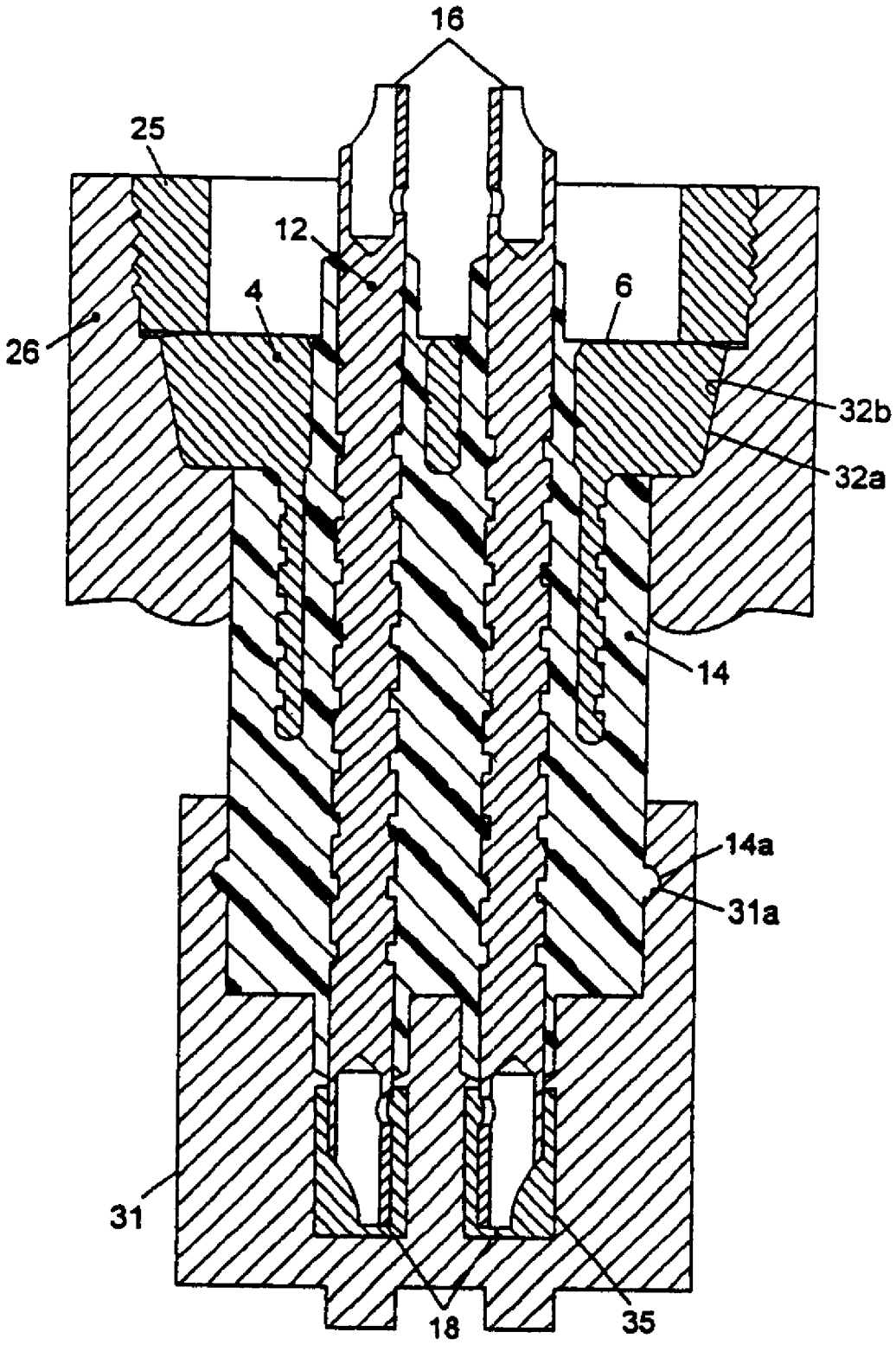
FIG. 5 shows the electrical feedthrough with a metal sealing surface and booted connections.

Welding is one method for forming a seal between the connector body 4 and the pressure bulkhead 26. In alternate embodiments, a metal-to-metal seal may be formed between the connector body 4 and the pressure bulkhead 26. Various types of metal-to-metal seals are known in the art. For example, as shown in FIG. 5, the flange 6 may be provided with a tapered sealing surface 32*a* which will form a metal-to-metal seal with a similarly tapered surface 32*b* in the pressure bulkhead 26. The tapered surfaces 32*a*, 32*b* would be held together to form the metal-to-metal by, for example, a retaining nut 25 secured to the pressure bulkhead 26. Other examples of metal-to-metal seals include C-seals, metal O-ring seals, compression tube fitting, and so forth. Any of these mechanisms may be employed to form a metal-to-metal seal between the connector body 4 and the pressure bulkhead 26.

Those skilled in the art will appreciate that other variations to the embodiments described above which are within the scope of the invention are possible. For example, the solder cups 16, 18 may be replaced with crimped/soldered connections or pin/socket contacts. In another embodiment, the contact pins 12 may be provided with booted connections. FIG. 5 shows a boot 31 which may be optionally provided around the solder cups 18 (and/or solder cups 16). In one embodiment, the boot 31, which is usually made of elastomer, has a groove 31*a* that snaps onto a retaining surface 14*a* on the connector body 18. Inside the boot 31*a* are liners 35 made of, for example, Teflon® (the well-known trademark for polytetrafluoroethylene). The liners 35 are mounted on the solder cups 18 and provide extra protection for the solder cups 18.

Figure 6:
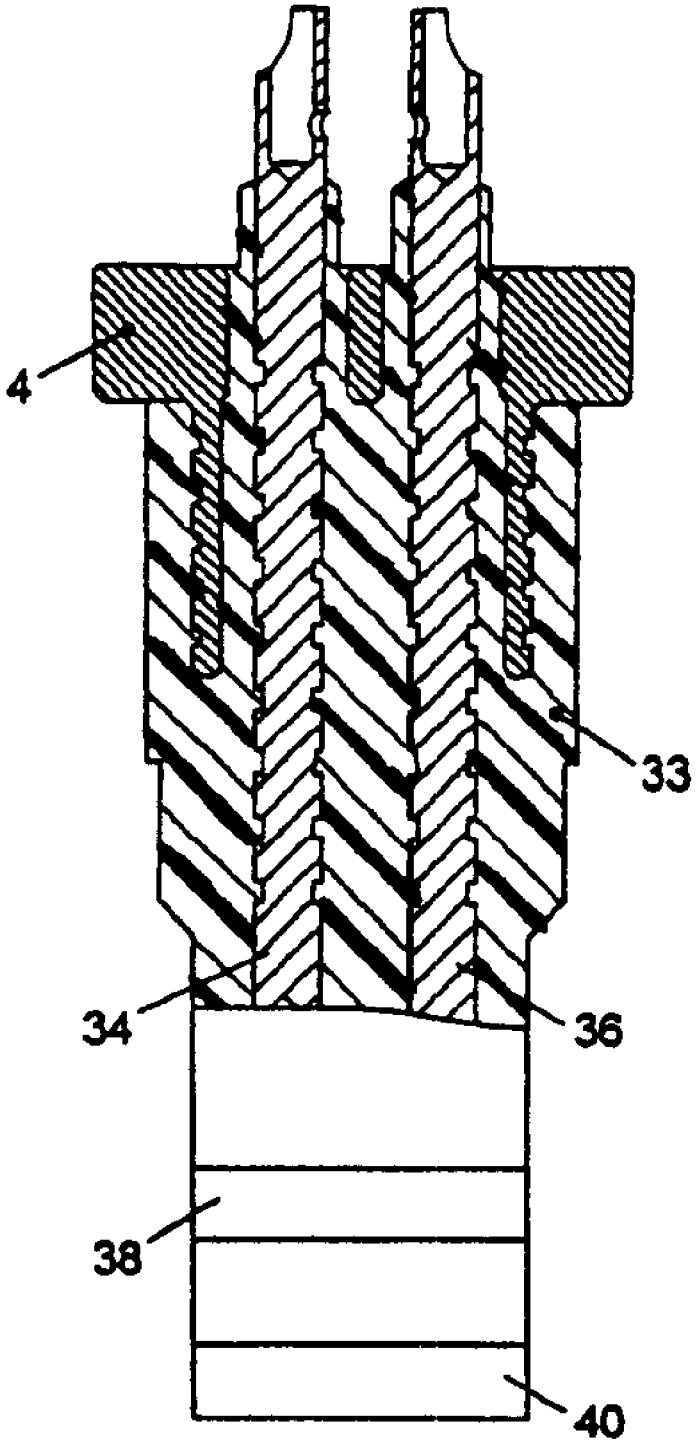
FIG. 6 is a vertical cross-section of a banded electrical feedthrough.
Figure 1:
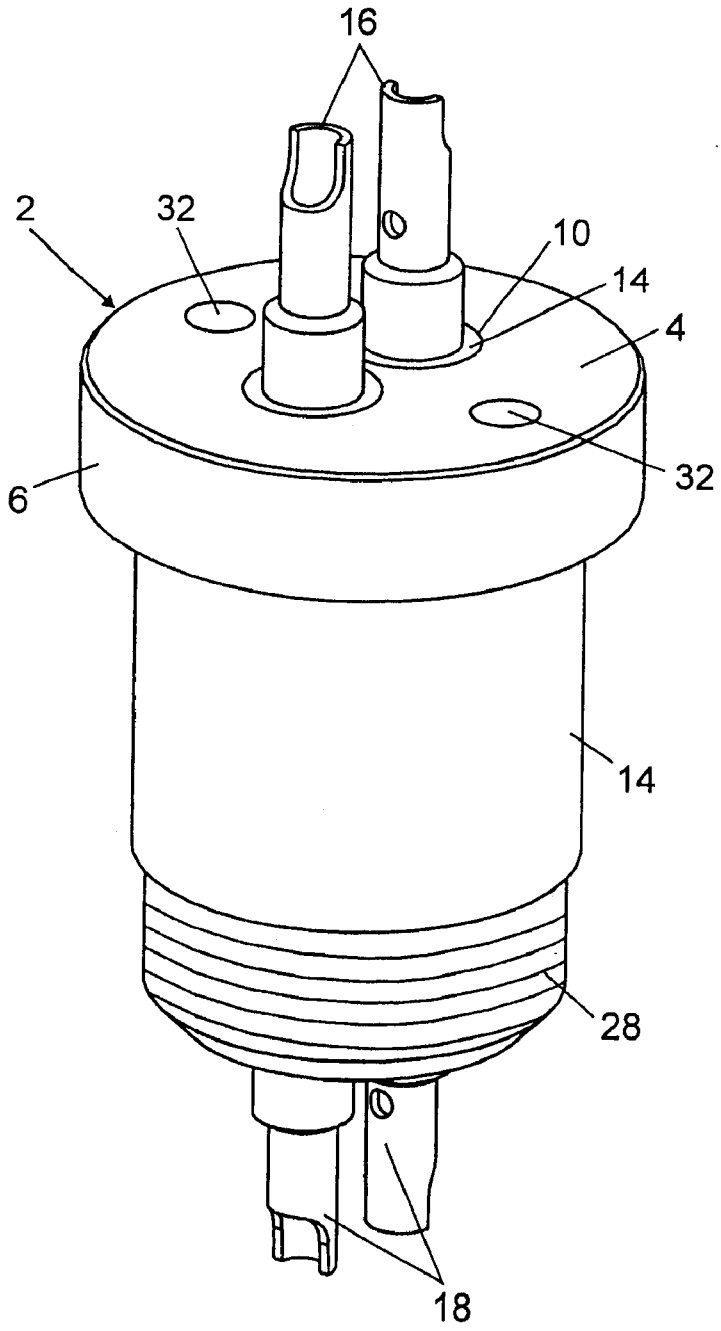
Figure 2:
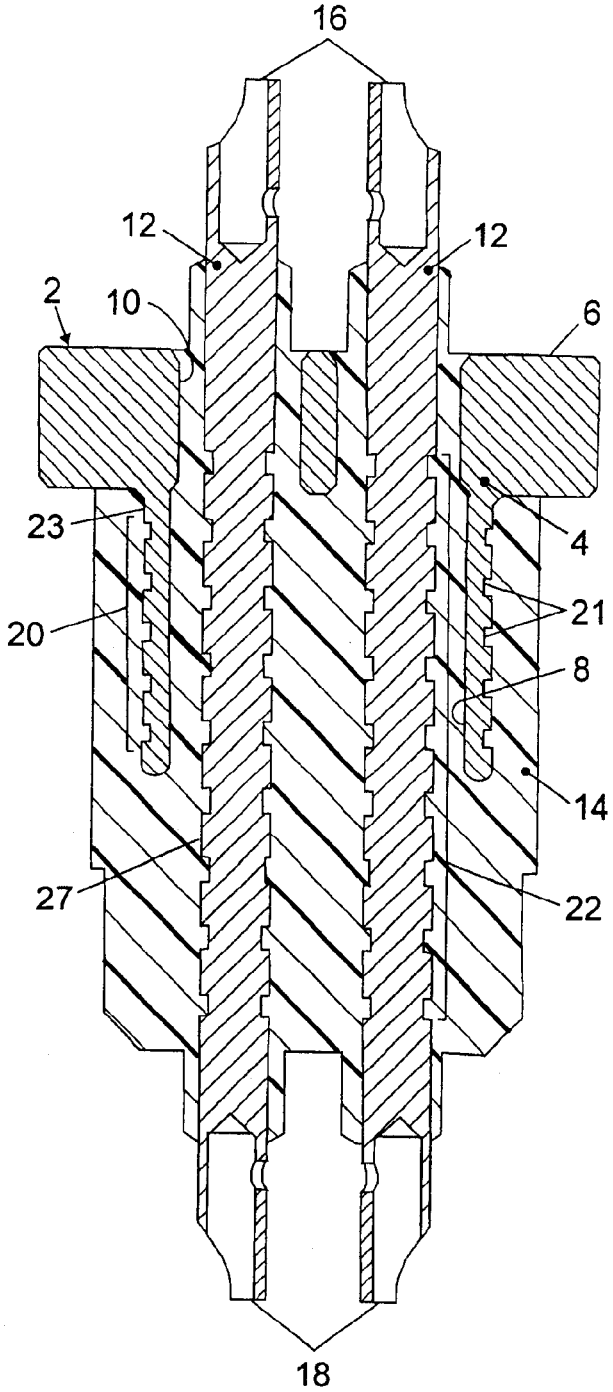
Figure 3:
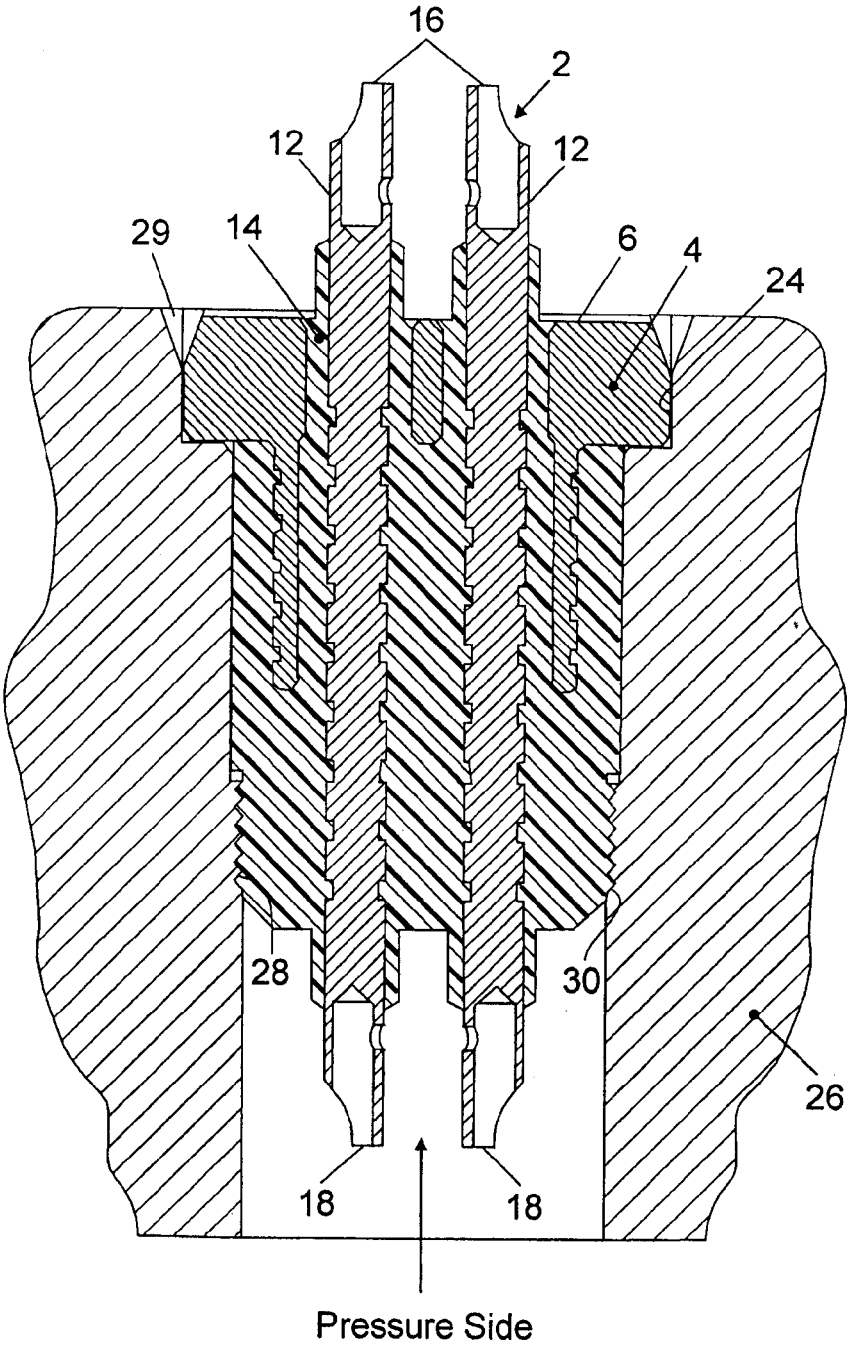
Figure 4:
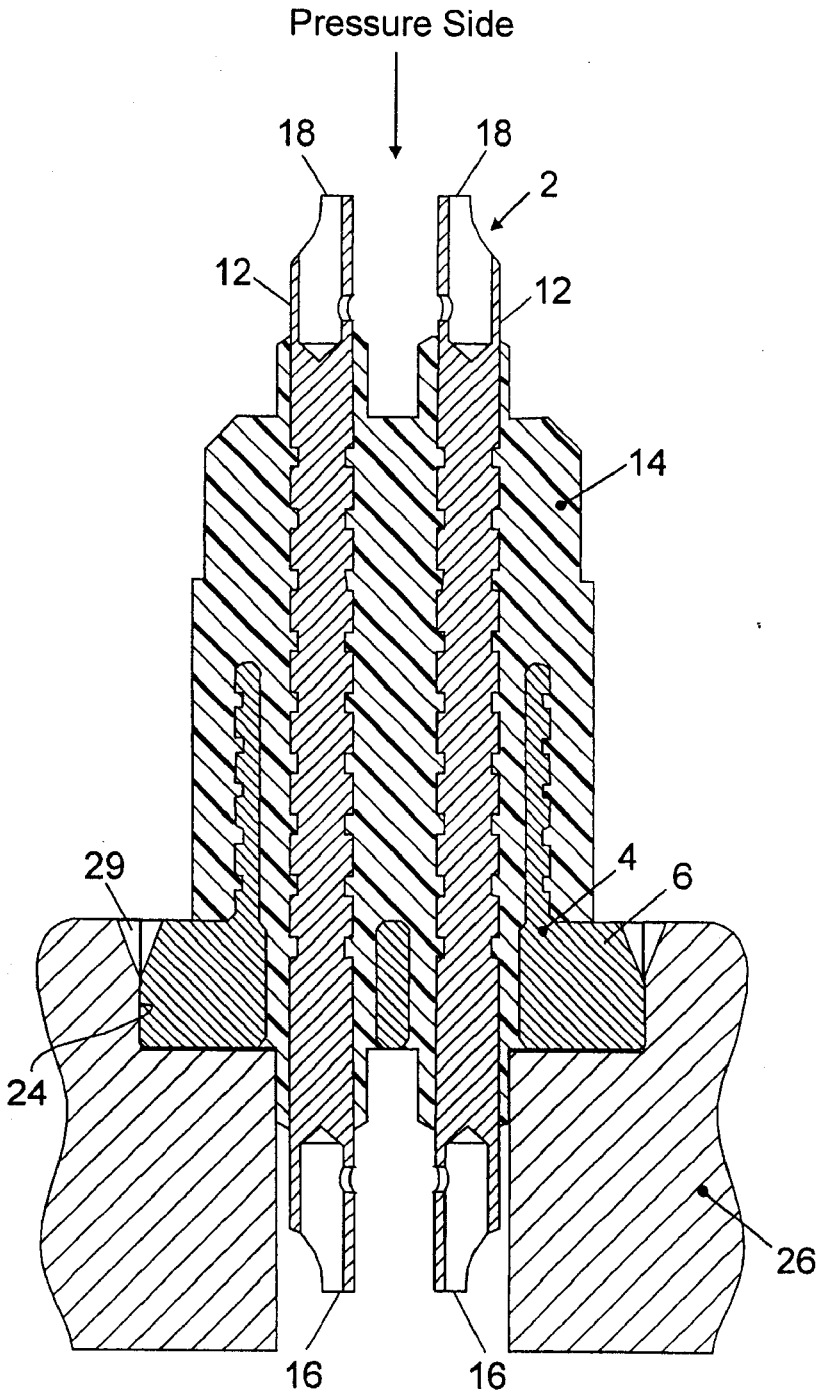
Figure 5:
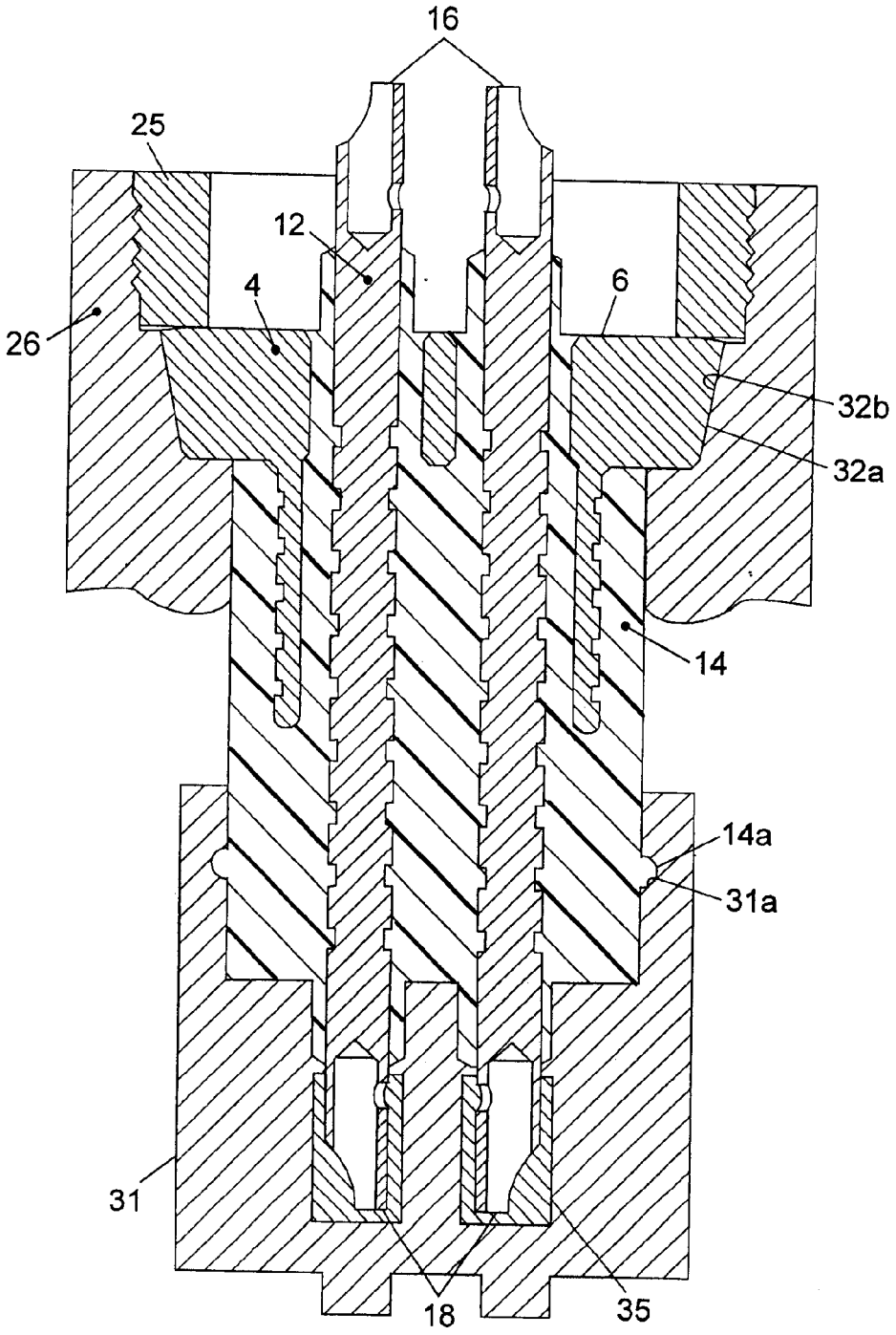
Figure 6:
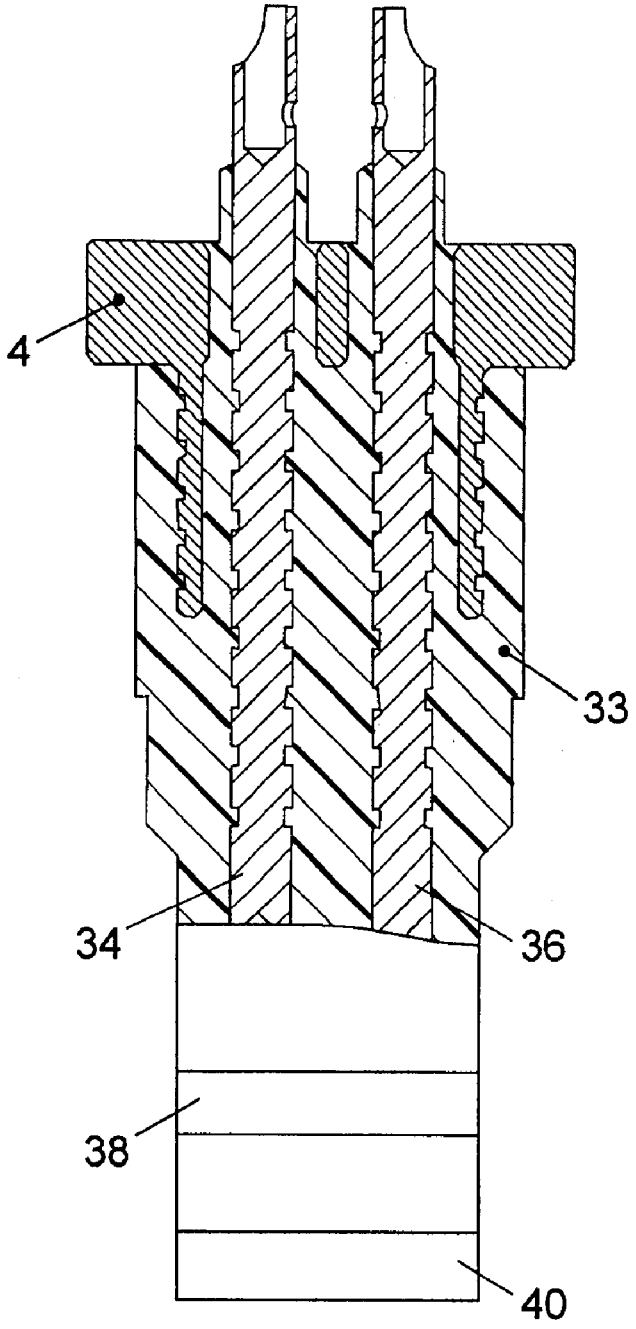

FIG. 6 shows another embodiment of the invention in which contact pins are connected to contact rings. In this embodiment, an insulating body 33 is formed around contact pins 34, 36 and connector body 4. The contact pins 34, 36, respectively, are connected to contact rings 38, 40 in the insulating body 33. Although only two contact pins 34, 36 and two contact rings 38, 40 are shown, it should be clear that the invention is not limited to these numbers. That is, the electrical feedthrough may include only one contact pin and contact ring or more than two contact rings and contact pins. Preferably, the insulating body 33 is formed of a thermoplastic material and is molded over the contact pins 34, 36, connector body 4, and contact rings 38, 40 in the manner previously described. This electrical feedthrough may be secured to a pressure bulkhead by welding or metal-to-metal seal in the manner previously described.

The invention provides general advantages. A fluid-tight seal is provided between the pressure bulkhead (or housing) and connector body by welding or by a metal-to-metal seal. This fluid-tight seal is not subject to failure as in the case of the elastomer seal. This allows the connector to survive long term in a high pressure, high temperature or vacuum environment. The thermoplastic material forms a hermetic seal between the connector body and the contact pins, preventing moisture from penetrating the feedthrough. The use of a thermoplastic material as an insulating and seal material also improves the long-term reliability of the connector because the shorting path to ground is lengthened in comparison to, for example, the standard glass-sealed feedthrough.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An electrical feedthrough, comprising:

a connector body made of a metallic material, the connector body comprising a mounting flange;

at least one contact pin inserted through a cavity in the connector body and through a hole in the mounting flange, the cavity and the hole each having a transverse dimension generally parallel to the face of the mounting flange, the transverse dimension of the hole, being less than that of the cavity; and an insulating body made of a thermoplastic material formed between the connector body and the contact pin, the insulating body molded over a portion of the connector body and the contact pin and providing a hermetic seal between the connector body and the contact pin; and wherein an outer surface of the connector body in contact with the insulating body includes an interlocking structure.

2. The electrical feedthrough of claim 1, wherein a surface of the contact pin in contact with the insulating body includes an interlocking structure.

3. The electrical feedthrough of claim 1, wherein the metallic material is corrosion-resistant.

4. The electrical feedthrough of claim 1, wherein the metallic material is weldable.

5. The electrical feedthrough of claim 1, wherein the connector body comprises a metal-to-metal sealing surface.

6. The electrical feedthrough of claim 1, further comprising a contact ring connected to the contact pin.

7. The electrical feedthrough of claim 6, wherein the contact ring is embedded in the insulating body.

8. An electrical feedthrough, comprising:

a connector body made of a weldable metallic material, the connector body comprising a welding flange;

at least one contact pin inserted through a cavity in the connector body and through a hole in the welding flange, the cavity and the hole each having a transverse dimension generally parallel to the face of the welding flange, the transverse dimension of the hole being less than that of the cavity; and an insulating body made of a thermoplastic material formed between the connector body and the contact pin, the insulating body molded over a portion of the connector body and the contact pin and providing a hermetic seal between the connector body and the contact pin; and wherein an outer surface of the connector body in contact with the insulating body includes an interlocking structure.

9. The electrical feedthrough of claim 8, wherein a surface of the contact pin in contact with the insulating body includes an interlocking structure.

10. The electrical feedthrough of claim 8, wherein the weldable metallic material is corrosion-resistant.

11. The electrical feedthrough of claim 8, further comprising at least one contact ring embedded in the insulating body, the contact ring being connected to the contact pin.

12. An electrical feedthrough, comprising:

a connector body made of a metallic material, the connector body comprising a mounting flange;

at least one contact pin inserted through a cavity in the connector body and through a hole in the mounting flange, the cavity and the hole each having a transverse dimension generally parallel to the face of the mounting flange, the transverse dimension of the hole being less than that of the cavity;

an interlocking structure formed on an outer surface of the connector body; and an insulating body made of a thermoplastic material formed over a portion of the connector body and the contact pin, the insulating body engaging the interlocking structure and providing a hermetic seal between the connector body and the contact pin.

13. The electrical feedthrough of claim 12, a surface of the contact pin in contact with the insulating body includes an interlocking structure.

14. The electrical feedthrough of claim 12, further comprising a contact ring embedded in the insulating body, the contact ring being connected to the contact pin.

15. The electrical feedthrough of claim 12, wherein the metallic material is weldable.

16. The electrical feedthrough of claim 12, wherein the connector body comprises a metal sealing surface.

17. A bulkhead electrical connection, comprising:

a bulkhead made of a weldable material;

a connector body made of a weldable material;

a weld formed between the bulkhead and the connector body at a face of the bulkhead;

at least one contact pin inserted through a cavity in the connector body and through a hole in the connector body, the cavity and the hole each having a transverse dimension generally parallel to the face of the bulkhead, the transverse dimension of the hole being less than that of the cavity; and an insulating body made of a thermoplastic material formed between the connector body and the contact pin, the insulating body providing a hermetic seal between the connector body and the pin; and wherein an outer surface of the connector body in contact with the insulating body includes an interlocking structure.

18. The bulkhead electrical connection of claim 17, wherein a surface of the contact pin in contact with the insulating body includes an interlocking structure.

19. The bulkhead electrical connection of claim 17, wherein mutually cooperating structures are provided on the bulkhead and the connector body to couple the connector body to the bulkhead.

20. The bulkhead electrical connection of claim 17, further comprising at least one contact ring embedded in the insulating body, the contact ring being connected to the contact pin.

* * * * *

UNITED STATES PATENT AND TRADEMARK OFFICE

CERTIFICATE OF CORRECTION

PATENT NO. : 6,506,083 B1
DATED : January 14, 2003
INVENTOR(S) : Bickford et al.

It is certified that error appears in the above-identified patent and that said Letters Patent is hereby corrected as shown below:

The title page, showing an illustrative figure, should be deleted and substitute therefor the attached title page.

Delete Drawing Sheets 1-6, and substitute therefor the Drawing Sheets, consisting of Figs 1-6, as shown on the attached pages.

Signed and Sealed this

Ninth Day of September, 2003

JAMES E. ROGAN
*Director of the United States Patent and Trademark Office*

(12) United States Patent
Bickford et al.

(10) Patent No.: US 6,506,083 B1
(45) Date of Patent: Jan. 14, 2003

(54) METAL-SEALED, THERMOPLASTIC ELECTRICAL FEEDTHROUGH

(75) Inventors: Gary P. Bickford, Houston, TX (US); Pete Howard, Bellville, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/681,247

(22) Filed: Mar. 6, 2001

(51) Int. Cl.[7] ..... H01R 13/405
(52) U.S. Cl. ..... 439/736; 439/281; 439/606
(58) Field of Search ..... 439/736, 281, 439/606

(56) References Cited

U.S. PATENT DOCUMENTS 3,624,585 A * 11/1971 Kokalas ..... 439/195
3,747,048 A * 7/1973 Johnson et al. ..... 439/276
3,848,950 A * 11/1974 McCormick et al. ..... 439/311
3,897,131 A * 7/1975 Stauffer ..... 439/655
4,296,986 A * 10/1981 Herrmann, Jr. ..... 439/322
4,441,777 A * 4/1984 Harootion ..... 339/94 M
6,165,013 A * 12/2000 Broussard ..... 439/606

* cited by examiner

*Primary Examiner*—Gary Paumen
*Assistant Examiner*—Ann McCamey
(74) *Attorney, Agent, or Firm*—Wayne I. Kanak; Brigitte L. Jeffery; John J. Ryberg

(57) ABSTRACT

An electrical feedthrough includes a connector body made of a metallic material, at least one contact pin inserted through a cavity in the connector body, and an insulating body made of a thermoplastic material formed between the connector body and the contact pin so as to provide a hermetic seal between the connector body and the contact pin.

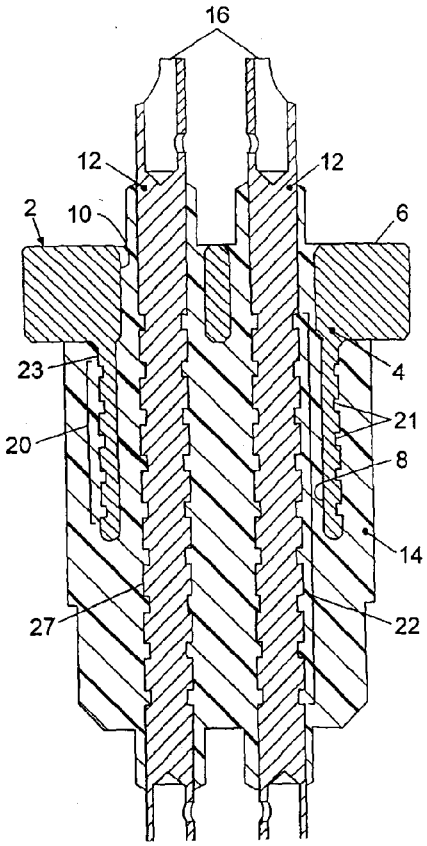

20 Claims, 6 Drawing Sheets